US005690802A

United States Patent [19]

Castegnier

[11] Patent Number: 5,690,802

[45] Date of Patent: Nov. 25, 1997

[54] METHOD OF INCREASING COAGULATION EFFICIENCY DURING ELECTROCOAGULATION PRINTING

[75] Inventor: Adrien Castegnier, Outremont, Canada

[73] Assignee: Elcorsy Technology Inc., Saint-Laurent, Canada

[21] Appl. No.: 786,658

[22] Filed: Jan. 21, 1997

[51] Int. Cl.[6] ..... C25D 13/04

[52] U.S. Cl. ..... 204/486; 204/483; 204/508; 101/DIG. 9

[58] Field of Search ..... 204/486, 483, 204/508; 101/DIG. 29

[56] References Cited

U.S. PATENT DOCUMENTS

| | | | |
|---|---|---|---|
| 4,661,222 | 4/1987 | Castegnier | 204/180.9 |
| 4,895,629 | 1/1990 | Castegnier | 204/180.9 |
| 5,449,392 | 9/1995 | Castegnier et al. | 218/46 |
| 5,538,601 | 7/1996 | Castegnier | 204/486 |

*Primary Examiner*—Kathryn L. Gorgos
*Assistant Examiner*—Kishor Mayekar
*Attorney, Agent, or Firm*—Swabey Ogilvy Renault

[57] ABSTRACT

An improved electrocoagulation printing method comprising the steps of (a) providing a positive electrolytically inert electrode formed of a trivalent metal and having a continuous passivated surface moving at substantially constant speed along a predetermined path, the passivated surface defining a positive electrode active surface; (b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and (c) bringing a substrate into contact with the dots of colored, coagulated colloid to cause transfer of the colored, coagulated colloid from the positive electrode active surface onto the substrate and thereby imprint the substrate with the image. The improvement resides in maintaining the positive electrode active surface and the ink at a temperature of about 35° C. to about 60° C. to increase the conductivity of the ink and the release of trivalent metal ions from the passivated surface into the ink in step (b) so that the trivalent metal ions initiate coagulation of the colloid and are released in a quantity sufficient to increase the optical density of the coagulated colloid, thereby increasing coagulation efficiency in step (b).

40 Claims, 1 Drawing Sheet

METHOD OF INCREASING COAGULATION EFFICIENCY DURING ELECTROCOAGULATION PRINTING

BACKGROUND OF THE INVENTION

The present invention pertains to improvements in the field of electrocoagulation printing. More particularly, the invention relates to a method of increasing coagulation efficiency during electrocoagulation printing.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

The electrocoagulation printing method described in the aforementioned U.S. Pat. No. 4,895,629 is carried out at room temperature which is generally about 25°–30° C. Applicant has observed that the maximum optical density of the dots of colored, coagulated colloid formed on the positive electrode active surface, that could be reached with an ink having a temperature of 30° C. and with a voltage of 55 volts applied for 4 micro-seconds between the negative and positive electrodes, was 1.60. By increasing the voltage to 60 volts under the same conditions, there was no valuable increase in the optical density of the coagulated colloid, but rather an undesirable gas generation between the electrodes. If the concentration of the electrolyte in the ink was reduced to control the gas generation, a reduction in the optical density of the coagulated colloid was observed.

SUMMARY OF THE INVENTION

It is therefore an object of the present invention to overcome the above drawbacks and to increase the efficiency of coagulation during electrocoagulation printing.

In accordance with the present invention, there is provided an improved electrocoagulation printing method comprising the steps of:

a) providing a positive electrolytically inert electrode formed of a trivalent metal and having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto the substrate and thereby imprint the substrate with the image;

the improvement which comprises maintaining the positive electrode active surface and the ink at a temperature of about 35° C. to about 60° C. to increase the conductivity of the ink and the release of trivalent metal ions from the passivated surface into the ink in step (b) so that the trivalent metal ions initiate coagulation of the colloid and are released in a quantity sufficient to increase the optical density of the coagulated colloid, thereby increasing coagulation efficiency in step (b).

As explained in Applicant's copending U.S. patent application Ser. No. 08/376,245 filed on Jan. 23, 1995 the teaching of which is incorporated herein by reference, a breakdown of passive oxide films occurs in the presence of electrolyte anions, such as $Cl^-$,$Br^-$ and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminum is utilized in Applicant's electrocoagulation printing method, dissolution of the passive oxide film on such an electrode generates $Fe^{3+}$ or $A1^{3+}$ ions. These trivalent ions then initiate coagulation of the colloid.

It has surprisingly been found, according to the invention, that by increasing the temperature of the positive electrode active surface as well as the temperature of the ink to within the range of from about 35° C. to about 60° C., and preferably to about 40° C., not only is there an increase in the conductivity of the ink which assists electrocoagulation, but there is also an increase in the rate of local dissolution of the passive oxide film on the positive electrode, which causes a greater quantity of trivalent metal ions to be released into the ink. If the temperature of the positive electrode active surface is below 35° C., the quantity of trivalent metal ions released into the ink is insufficient for obtaining the desired increase in the optical density of the coagulated colloid. At a temperature above 60° C., problems such as condensation of water vapor on the equipment are encountered.

When operating with an ink having a temperature of about 40° C. and a reduced electrolyte concentration and with a voltage of 60 volts, the method according to the invention enables one to obtain dots of colored, coagulated colloid having an optical density of 1.70.

BRIEF DESCRIPTION OF THE DRAWINGS

In the accompanying drawings.

DESCRIPTION OF PREFERRED EMBODIMENTS

Figure 1:
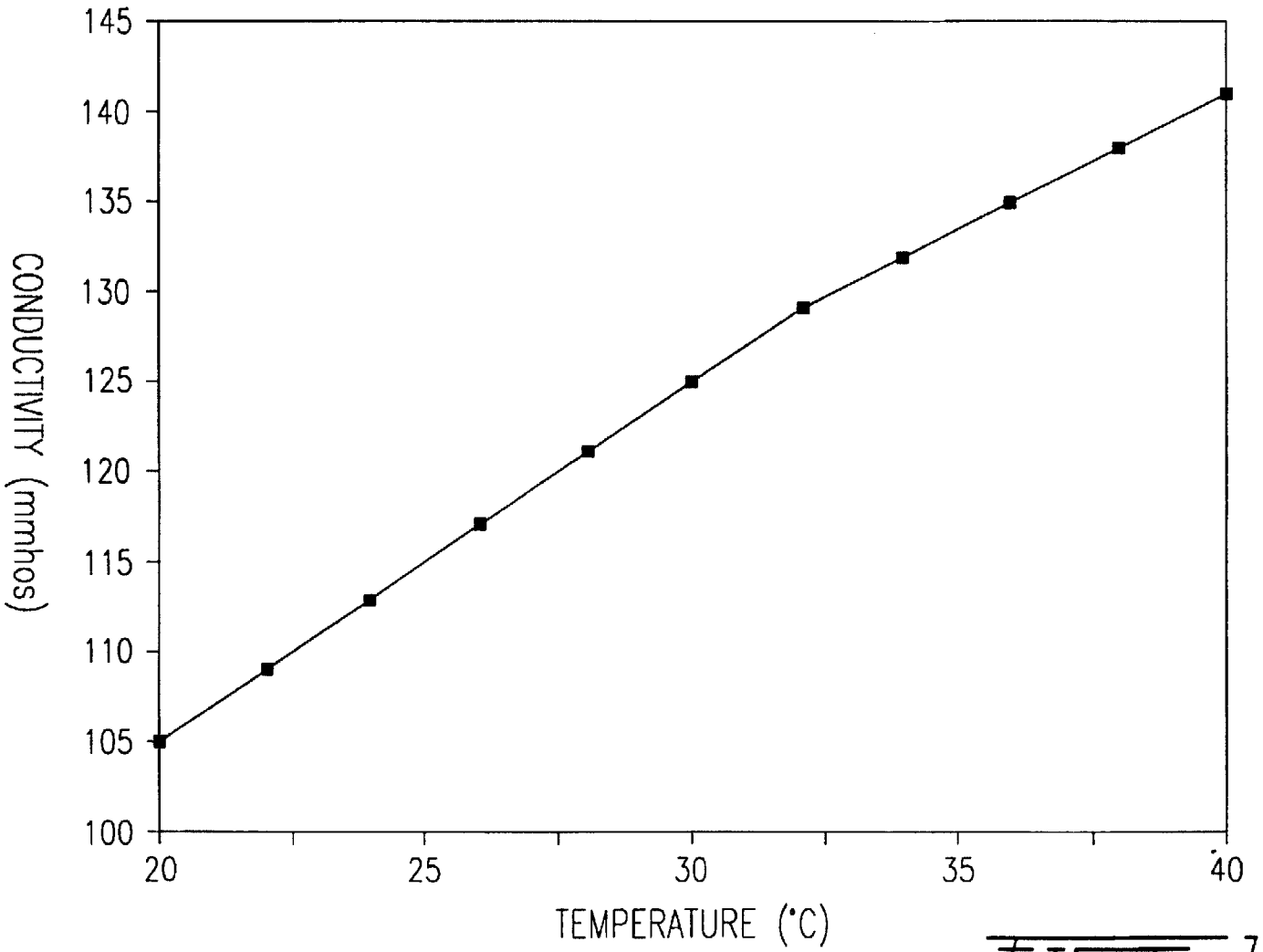
FIG. 1 is a graph showing the variation of the ink conductivity as a function of its temperature. As shown, the conductivity of the electrocoagulation printing ink according to the invention increases as the temperature thereof increases.

Where a polychromic image is desired, steps (b) and (c) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image.

The positive electrode used can be in the form of a moving endless belt as described in Applicant's U.S. Pat. No. 4,661,222, or in the form of a revolving cylinder as described in the aforementioned U.S. Pat. No. 4,895,629 or in Applicant's U.S. Pat. No. 5,538,601, the teachings of which are incorporated herein by reference. In the later case, the printing stages are arranged around the positive cylindrical electrode. Preferably, the positive electrode active surface and the ink are maintained at a temperature of about 35°–60° C. by heating the positive electrode active surface and applying the ink on the heated electrode surface to cause a transfer of heat therefrom to the ink.

When use is made of a positive electrode of cylindrical configuration rotating at substantially constant speed about its central longitudinal axis, step (b) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) coating the positive electrode active surface with an olefinic substance and a metal oxide to form on the surface micro-droplets of olefinic substance containing the metal oxide;

iii) filling the electrode gap with the aforesaid electrocoagulation printing ink;

iv) electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming the dots of colored, coagulated colloid; and v) removing any remaining non-coagulated colloid from the positive electrode active surface.

As explained in U.S. Patent No. 4,895,629, spacing of the negative electrodes from one another by a distance which is equal to or greater than the electrode gap prevents the negative electrodes from undergoing edge corrosion. On the other hand, coating of the positive electrode with an olefinic substance and a metal oxide prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, platinum, chromium, nickel and aluminum. The positive electrode is preferably made of stainless steel, aluminum or tin so that upon electrical energization of the negative electrodes, dissolution of the passive oxide film on such an electrode generates trivalent ions which then initiate coagulation of the colloid.

The gap which is defined between the positive and negative electrodes can range from about 50 μm to about 100 μm, the smaller the electrode gap the sharper are the dots of coagulated colloid produced. Where the electrode gap is of the order of 50 μm, the negative electrodes are the preferably spaced from one another by a distance of about 75 μm.

Examples of suitable olefinic substances which may be used to coat the surface of the positive electrode in step (b)(ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. The olefinic substance is advantageously applied onto the positive electrode active surface in the form of an oily dispersion containing the metal oxide as dispersed phase. Examples of suitable metal oxides include aluminum oxide, ceric oxide, chromium oxide, cupric oxide, magnesium oxide, manganese oxide, titanium dioxide and zinc oxide; chromium oxide is the preferred metal oxide. Depending on the type of metal oxide used, the amount of metal oxide may range from about 15 to about 40% by weight, based on the total weight of the dispersion. A particularly preferred dispersion contains about 75 wt. % of oleic acid or linoleic acid and about 25 wt. % of chromium oxide. Operating at a temperature of about 35°–60° C. enables one to lower the concentration of metal oxide in the oily dispersion and thus to reduce wear of the positive electrode active surface.

The oily dispersion containing the olefinic substance and the metal oxide is advantageously applied onto the positive electrode active surface by providing a distribution roller extending parallel to the positive cylindrical electrode and having a peripheral coating comprising an oxide ceramic material, applying the oily dispersion onto the ceramic coating to form on a surface thereof a film of the oily dispersion uniformly covering the surface of the ceramic coating, the film of oily dispersion breaking down into micro-droplets containing the olefinic substance in admixture with the metal oxide and having substantially uniform size and distribution, and transferring the micro-droplets from the ceramic coating onto the positive electrode active surface. As explained in Applicant's U.S. Pat. No. 5,449,392 of Sep. 12, 1995, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the metal oxide and having substantially uniform size and distribution. The microdroplets formed on the surface of the ceramic coating and transferred onto the positive electrode active surface generally have a size ranging from about 1 to about 5μ.

A particularly preferred oxide ceramic material forming the aforesaid ceramic coating comprises a fused mixture alumina and titania. Such a mixture may comprise about 60 to about 90 weight % of alumina and about 10 to about 40 weight % of titania.

According to a preferred embodiment of the invention, the oily dispersion is applied onto the ceramic coating by disposing an applicator roller parallel to the distribution roller and in pressure contact engagement therewith to form a first nip, and rotating the applicator roller and the distribution roller in register while feeding the oily dispersion into the first nip, whereby the oily dispersion upon passing through the first nip forms a film uniformly covering the surface of the ceramic coating. The micro-droplets are advantageously transferred from the distribution roller to the positive electrode by disposing a transfer roller parallel to the distribution roller and in contact engagement therewith to form a second nip, positioning the transfer roller in pressure contact engagement with the positive electrode to form a third nip, and rotating the transfer roller and the positive electrode in register for transferring the micro-droplets from the distribution roller to the transfer roller at the second nip and thereafter transferring the micro-droplets from the transfer roller to the positive electrode at the third nip. Such an arrangement of rollers is described in the aforementioned U.S. Pat. No. 5,449,392.

Preferably, the applicator roller and the transfer roller are each provided with a peripheral covering of a resilient material which is resistant to attack by the olefinic substance, such as a synthetic rubber material. For example, use can be made of a polyurethane having a Shore A hardness of about 50 to about 70 in the case of the applicator roller, or a Shore A hardness of about 60 to about 80 in the case of the transfer roller.

In some instances, depending on the type of olefinic substance used, Applicant has noted that the film of oily dispersion only partially breaks down on the surface of the ceramic coating into the desired micro-droplets. Thus, in order to ensure that the film of oily dispersion substantially completely breaks on the ceramic coating into micro-droplets of olefinic substance containing the metal oxide and having substantially uniform size and distribution, step (b)(ii) of the electrocoagulation printing method of the invention is preferably carried out by providing first and second distribution rollers extending parallel to the positive cylindrical electrode and each having a peripheral coating comprising an oxide ceramic material, applying the oily dispersion onto the ceramic coating of the first distribution roller to form on a surface thereof a film of the oily dispersion uniformly covering the surface of the ceramic coating, the film of oily dispersion at least partially breaking down into micro-droplets containing the olefinic substance in admixture with the metal oxide and having substantially uniform size and distribution, transferring the at least partially broken film from the first distribution roller to the second distribution roller so as to cause the film to substantially completely break on the ceramic coating of the second distribution roller into the desired micro-droplets having substantially uniform size and distribution, and transferring the micro-droplets from the ceramic coating of the second distribution roller onto the positive electrode active surface. Preferably, the ceramic coatings of the first distribution roller and the second distribution roller comprise the same oxide ceramic material. Such an arrangement of rollers is described in Applicant's U.S. Pat. No. 5,538,601 of Jul. 23, 1996, the teaching of which is incorporated herein by reference.

According to a preferred embodiment, the oily dispersion is applied onto the ceramic coating of the first distribution roller by disposing an applicator roller parallel to the first distribution roller and in pressure contact engagement therewith to form a first nip, and rotating the applicator roller and the first distribution roller in register while feeding the oily dispersion into the first nip, whereby the oily dispersion upon passing through the first nip forms a film uniformly covering the surface of the ceramic coating.

According to another preferred embodiment, the at least partially broken film of oily dispersion is transferred from the first distribution roller to the second distribution roller and the micro-droplets are transferred from the second distribution roller to the positive electrode by disposing a first transfer roller between the first distribution roller and the second distribution roller in parallel relation thereto, positioning the first transfer roller in pressure contact engagement with the first distribution roller to form a second nip and in contact engagement with the second distribution roller to form a third nip, rotating the first distribution roller and the first transfer roller in register for transferring the at least partially broken film from the first distribution roller to the first transfer roller at the second nip, disposing a second transfer roller parallel to the second distribution roller and in pressure contact engagement therewith to form a fourth nip, positioning the second transfer roller in pressure contact engagement with the positive electrode to form a fifth nip, and rotating the second distribution roller, the second transfer roller and the positive electrode in register for transferring the at least partially broken film from the first transfer roller to the second distribution roller at the third nip, then transferring the micro-droplets from the second distribution roller to the second transfer roller at the fourth nip and thereafter transferring the micro-droplets from the second transfer roller to the positive electrode at the fifth nip. Such an arrangement of rollers is also described in the aforementioned U.S. Pat. No. 5,538,601. Preferably, the applicator roller, first transfer roller and second transfer roller are each provided with a peripheral covering of a resilient material which is resistant to attack by the olefinic substance.

The olefin and metal oxide-coated positive active surface is preferably polished to increase the adherence of the micro-droplets onto the positive electrode active surface, prior to step (b) (iii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the microdroplets onto the positive electrode active surface.

Where the positive cylindrical electrode extends vertically, step (b)(iii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a molecular weight comprised between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a molecular weight of about 250,000 and sold by Cyanamid Inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The electrolyte is preferably used in an amount of about 4.5 to about 6% by weight, based on the total weight of the dispersion. Thus, less electrolyte is required at a temperature of about 35°–60° C. than at room temperature in order to counterbalance the increase in the ink conductivity at 35°–60° C. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the nonionic dispersing agent sold by ICI Canada Inc. under the trade mark SOLSPERSE 27000. The pigment is preferably used in an amount of about 6.5 to about 12% by weight, and the dispersing agent in an amount of about 0.4 to about 6% by weight, based on the total weight of the ink.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

According to a preferred embodiment, the substrate is in the form of a continuous web which is passed through the respective transfer positions for being imprinted with the colored images at the printing stages. Step (c) is preferably carried out by providing at each transfer position a pressure roller extending parallel to the positive cylindrical electrode and in pressure contact engagement therewith to form a nip and permit the pressure roller to be driven by the positive electrode upon rotation thereof, and guiding the web so as to pass through the nip.

Preferably, the pressure roller is provided with a peripheral covering of a synthetic rubber material such as a polyurethane having a Shore A hardness of about 95. A polyurethane covering with such a hardness has been found to improve transfer of the colored, coagulated colloid from the positive electrode active surface onto the substrate. The pressure exerted between the positive electrode and the pressure roller preferably ranges from about 50 to about 100 $kg/cm^2$.

After step (c), the positive electrode active surface is generally cleaned to remove therefrom any remaining coagulated colloid. According to a preferred embodiment, the positive electrode is rotatable in a predetermined direction and any remaining coagulated colloid is removed from said positive electrode active surface by providing an elongated rotatable brush extending parallel to the longitudinal axis of the positive electrode, the brush being provided with a plurality of radially extending bristles made of horsehair and having extremities contacting said positive electrode active surface, rotating the brush in a direction opposite to the direction of rotation of the positive electrode so as to cause said bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35°–60° C. by heating the cleaning liquid to thereby heat the positive electrode active surface upon contacting same and applying the ink on the heated electrode surface to cause a transfer of heat therefrom to the ink.

I claim:

1. In an electrocoagulation printing method comprising the steps of:

a) providing a positive electrolytically inert electrode formed of a trivalent metal and having a continuous passivated surface moving at constant speed along a selected path, said passivated surface defining a positive electrode active surface;

b) forming on said positive electrode active surface a plurality of dots of colored, coagulated colloid representative of a selected image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and c) bringing a substrate into contact with the dots of colored, coagulated colloid to cause transfer of the dots of colored, coagulated colloid from the positive electrode active surface onto said substrate and to imprint said substrate with said image; the improvement which comprises maintaining said positive electrode active surface and said ink at a temperature of about 35° C. to about 60° C. to increase conductivity of said ink and release of trivalent metal ions from said passivated surface into said ink in step (b) such that the trivalent metal ions initiate coagulation of said colloid and are released in a quantity sufficient to increase optical density of the coagulated colloid.

2. A method as claimed in claim 1, wherein the temperature of said positive electrode active surface and said ink is about 40° C.

3. A method as claimed in claim 1, wherein said ink is maintained at said temperature by heating said positive electrode active surface and applying said ink on the heated electrode surface to cause a transfer of heat therefrom to said ink.

4. A method as claimed in claim 1, wherein said dispersing medium is water and said electrolyte is selected from the group consisting of alkali metal halides and alkaline earth metal halides.

5. A method as claimed in claim 4, wherein said electrolyte is present in said ink in an amount of about 4.5 to about 6% by weight, based on the total weight of the ink.

6. A method as claimed in claim 5, wherein said electrolyte is potassium chloride.

7. A method as claimed in claim 1, wherein said trivalent metal ions are ferric ions.

8. A method as claimed in claim 7, wherein said trivalent metal is stainless steel.

9. A method as claimed in claim 1, wherein steps (b) and (c) are repeated several times to define a corresponding number of printing stages arranged at selected locations along said path and each using a coloring agent of different color, and to produce several differently colored images of coagulated colloid which are transferred at respective transfer positions onto said substrate in superimposed relation to provide a polychromic image.

10. A method as claimed in claim 9, wherein said positive electrode is a cylindrical electrode having a central longitudinal axis and rotating at substantially constant speed about said longitudinal axis, and wherein said printing stages are arranged around said positive cylindrical electrode.

11. A method as claimed in claim 10, wherein step (b) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant selected gap, said negative electrodes being spaced from one another by a distance at least equal to said electrode gap;

ii) coating the positive electrode active surface with an olefinic substance and a metal oxide to form on said surface micro-droplets of olefinic substance containing the metal oxide;

iii) filling said electrode gap with said electrocoagulation printing ink;

iv) electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, to form said dots of colored, coagulated colloid; and v) removing any remaining non-coagulated colloid from said positive electrode active surface.

12. A method as claimed in claim 11, wherein step (b) (ii) is carried out by providing a distribution roller extending parallel to said positive electrode and having a peripheral ceramic coating comprising an oxide ceramic material, applying said olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said olefinic substance in admixture with said metal oxide and having substantially uniform size and distribution, and transferring said micro-droplets from said ceramic coating onto said positive electrode active surface.

13. A method as claimed in claim 12, wherein said oxide ceramic material comprises a fused mixture of alumina and titania.

14. A method as claimed in claim 12, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, such that said oily dispersion upon passing through said first nip forms said film uniformly covering the surface of said ceramic coating.

15. A method as claimed in claim 14, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

16. A method as claimed in claim 15, wherein said applicator roller and said transfer roller are each provided with a peripheral covering of a resilient material which is resistant to attack by said olefinic substance.

17. A method as claimed in claim 11, wherein step (b) (ii) is carried out by providing first and second distribution rollers extending parallel to said positive electrode and each having a peripheral ceramic coating comprising an oxide ceramic material, applying said olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said olefinic substance in admixture with said metal oxide and having uniform size and distribution, transferring the at least partially broken film from said first distribution roller to said second distribution roller to cause said film to completely break on the ceramic coating of said second distribution roller into said micro-droplets having uniform size and distribution, and transferring said micro-droplets from the ceramic coating of said second distribution roller onto said positive electrode active surface.

18. A method as claimed in claim 17, wherein the ceramic coatings of said first distribution roller and said second distribution roller comprise the same oxide ceramic material, and wherein said oxide ceramic material comprises a fused mixture of alumina and titania.

19. A method as claimed in claim 17, wherein said oily dispersion is applied onto the ceramic coating of said first distribution roller by disposing an applicator roller parallel to said first distribution roller and in pressure contact engagement therewith to form a first nip, and rotating said applicator roller and said first distribution roller in register while feeding said oily dispersion into said first nip, such that said oily dispersion upon passing through said first nip forms said film uniformly covering the surface of said ceramic coating.

20. A method as claimed in claim 19, wherein said at least partially broken film of oily dispersion is transferred from said first distribution roller to said second distribution roller and said micro-droplets are transferred from said second distribution roller to said positive electrode by disposing a first transfer roller between said first distribution roller and said second distribution roller in parallel relation thereto, positioning said first transfer roller in pressure contact engagement with said first distribution roller to form a second nip and in contact engagement with said second distribution roller to form a third nip, rotating said first distribution roller and said first transfer roller in register for transferring said at least partially broken film from said first distribution roller to said first transfer roller at said second nip, disposing a second transfer roller parallel to said second distribution roller and in pressure contact engagement therewith to form a fourth nip, positioning said second transfer roller in pressure contact engagement with said positive electrode to form a fifth nip, and rotating said second distribution roller, said second transfer roller and said positive electrode in register for transferring said at least partially broken film from said first transfer roller to said second distribution roller at said third nip, then transferring said micro-droplets from said second distribution roller to said second transfer roller at said fourth nip and thereafter transferring said micro-droplets from said second transfer roller to said positive electrode at said fifth nip.

21. A method as claimed in claim 20, wherein said applicator roller, said first transfer roller and said second transfer roller are each provided with a peripheral covering of a resilient material which is resistant to attack by said olefinic substance.

22. A method as claimed in claim 11, further including the step of polishing the olefin and metal oxide-coated positive electrode active surface to increase adherence of said micro-droplets onto said positive electrode active surface, prior to step (b) (iii) of each printing stage.

23. A method as claimed in claim 11, wherein said olefinic substance is selected from the group consisting of arachidonic acid, oleic acid, linoleic acid, linolenic acid, palmitoleic acid, corn oil, linseed oil, olive oil, peanut oil, soybean oil and sunflower oil, and wherein said metal oxide is selected from the group consisting of aluminum oxide, ceric oxide, chromium oxide, cupric oxide, magnesium oxide, manganese oxide, titanium dioxide and zinc oxide.

24. A method as claimed in claim 23, wherein said metal oxide is present in said oily dispersion in an amount of about 15 to about 40% by weight, based on the total weight of the dispersion.

25. A method as claimed in claim 23, wherein said olefinic substance is oleic acid or linoleic acid and said metal oxide is chromium oxide.

26. A method as claimed in claim 25, wherein said oily dispersion contains about 75 wt. % of oleic acid or linoleic acid and about 25 wt. % of chromium oxide.

27. A method as claimed in claim 11, wherein said dispersing medium is water and said electrolyte is selected from the group consisting of alkali metal halides and alkaline earth metal halides.

28. A method as claimed in claim 27, wherein said electrolyte is present in said ink in an amount of about 4.5 to about 6% by weight, based on the total weight of the ink.

29. A method as claimed in claim 28, wherein said electrolyte is potassium chloride.

30. A method as claimed in claim 11, wherein said trivalent metal ions are ferric ions.

31. A method as claimed in claim 30, wherein said trivalent metal is stainless steel.

32. A method as claimed in claim 10, wherein the temperature of said positive electrode active surface and said ink is about 40° C.

33. A method as claimed in claim 10, wherein said ink is maintained at said temperature by heating said positive electrode active surface and applying said ink on the heated electrode surface to cause a transfer of heat therefrom to said ink.

34. A method as claimed in claim 10, wherein said substrate is in the form of a continuous web which is passed through said respective transfer positions for being imprinted with said colored images at said printing stages.

35. A method as claimed in claim 34, wherein step (c) is carried out by providing at each transfer position a pressure roller extending parallel to said positive electrode and in pressure contact engagement therewith to form a nip and permit said pressure roller to be driven by said positive electrode upon rotation thereof, and guiding said web to pass through said nip.

36. A method as claimed in claim 35, wherein each said pressure roller is provided with a peripheral covering of a synthetic rubber material.

37. A method as claimed in claim 36, wherein said synthetic rubber material comprises a polyurethane having a Shore A hardness of about 95.

38. A method as claimed in claim 10, further including the step of removing after step (c) of each printing stage any remaining coagulated colloid from said positive electrode active surface.

39. A method as claimed in claim 38, wherein said positive electrode is rotatable in a selected direction and wherein any remaining coagulated colloid is removed from said positive electrode active surface by providing an elongated rotatable brush extending parallel to the longitudinal axis of said positive electrode, said brush being provided with a plurality of radially extending bristles having extremities contacting said positive electrode active surface, rotating said brush in a direction opposite to the direction of rotation of said positive electrode to cause said bristles to frictionally engage said positive electrode active surface, and directing jets of cleaning liquid under pressure against said positive electrode active surface, from either side of said brush.

40. A method as claimed in claim 39, wherein said positive electrode active surface and said ink are maintained at said temperature by heating said cleaning liquid to heat said positive electrode active surface upon contacting same and applying said ink on the heated electrode surface to cause a transfer of heat therefrom to said ink.

* * * * *